United States Patent [19]

du Chambon

[11] 3,939,783

[45] Feb. 24, 1976

[54] FURNACE FOR INCINERATING WASTE MATERIALS

[75] Inventor: Michel Georges Jean Picard du Chambon, Versailles, France

[73] Assignee: B. V. Peximac, Netherlands, Netherlands

[22] Filed: Sept. 23, 1974

[21] Appl. No.: 508,355

[30] Foreign Application Priority Data

Sept. 28, 1973 France ..... 73.34778

[52] U.S. Cl. ..... 110/14; 110/19; 432/105

[51] Int. Cl.[2] ..... F23G 5/06

[58] Field of Search ..... 34/135, 136, 137; 432/251, 432/103, 105, 107, 108, 109; 110/14, 19

[56] References Cited

UNITED STATES PATENTS

| | | | |
|---|---|---|---|
| 2,127,328 | 8/1938 | Egan | 110/19 X |
| 2,915,877 | 12/1959 | Darling | 432/251 X |
| 2,985,120 | 5/1961 | Brandt et al. | 110/19 X |
| 3,050,868 | 8/1962 | Erisman et al. | 34/136 |
| 3,408,969 | 11/1968 | Maurice | 110/14 |
| 3,631,824 | 1/1972 | Smuck | 110/14 |
| 3,682,117 | 8/1972 | Rousseau | 110/19 X |

*Primary Examiner*—Kenneth W. Sprague
*Attorney, Agent, or Firm*—Marn & Jangarathis

[57] ABSTRACT

Technical sector: Incinerator unit of average capacity having a rotary grate for household refuse and industrial waste. Main technical characteristic of the invention: The incinerator is formed of a stationary casing and a metallic rotary grate of frusto-conical configuration made of juxtaposed cylindrical rings of decreasing diameters, formed of plane or curved members which may be modular plates identical for the entire grate. The incinerator has a pre-drying chamber. The ash pit serves as a basis for the entire unit. Main applications of the invention: Basic members of mobile, removable or stationary incinerator units and of incinerator plants for household refuse and industrial waste.

10 Claims, 5 Drawing Figures

FURNACE FOR INCINERATING WASTE MATERIALS

The present invention concerns incinerators and in particular incinerators for household refuse and industrial waste.

In the present state of the art the incinerators having an average destructive capacity, with their associated charging, smoke purification, and ash evacuation units, constitutes heavy complexes which are cumbersome and expensive, while their installation leads to the realization of a plant whose maintenance is important and the erection of which requires a certain time.

The incinerators according to the invention make it possible to obviate the above drawbacks because they are basically constructed as a compact, light and possibly self-contained.

According to one embodiment of the invention said selfcontained incineration unit is mounted on an autotruck, allowing to incinerate the refuse in proportion to its collection. The selfcontained incineration units according to the invention are basically composed of a filling device, an incinerator proper, a smoke purification system, an ash pit provided with ash extinction means and finally a power source.

The incinerator according to the invention is constituted by a casing of sheet steel wherein rotates a grate having the form of a body of revolution constituted by sheet steel members adapted to be easily replaced and for permitting their free expansion, said assembly being self-sustaining and having no armature. The entrance of the incinerator is connected by a pre-drying chamber to the filling apparatus. The exit of the incinerator opens into an ash pit, disposed underneath a water reservoir of the smoke purification system. The smoke purification system comprises zones for post-combustion of smoke and an apparatus for smoke dust removal, said various members being distributed above and adjacent the entrance and the exit of the incinerator. The ash pit extends underneath the entire length of the incinerator unit towards the incinerator exit, and is situated underneath a water reservoir of the dust removal apparatus, extending underneath the incinerator proper, then underneath the filling apparatus to open into the lower part of the end face of the filling apparatus. The water contained in the reservoir, located at the other end of the unit, is emptied in the as pit at the end of the operation, so as to extinguish the ashes and to remove same for evacuation.

The following description with respect to the enclosed drawings will explain how the invention can be realized; it is given by way of a non-limitative example of an embodiment of the present invention, the characteristics of which appear both from the drawings and from the pertinent text.

Figure 1:
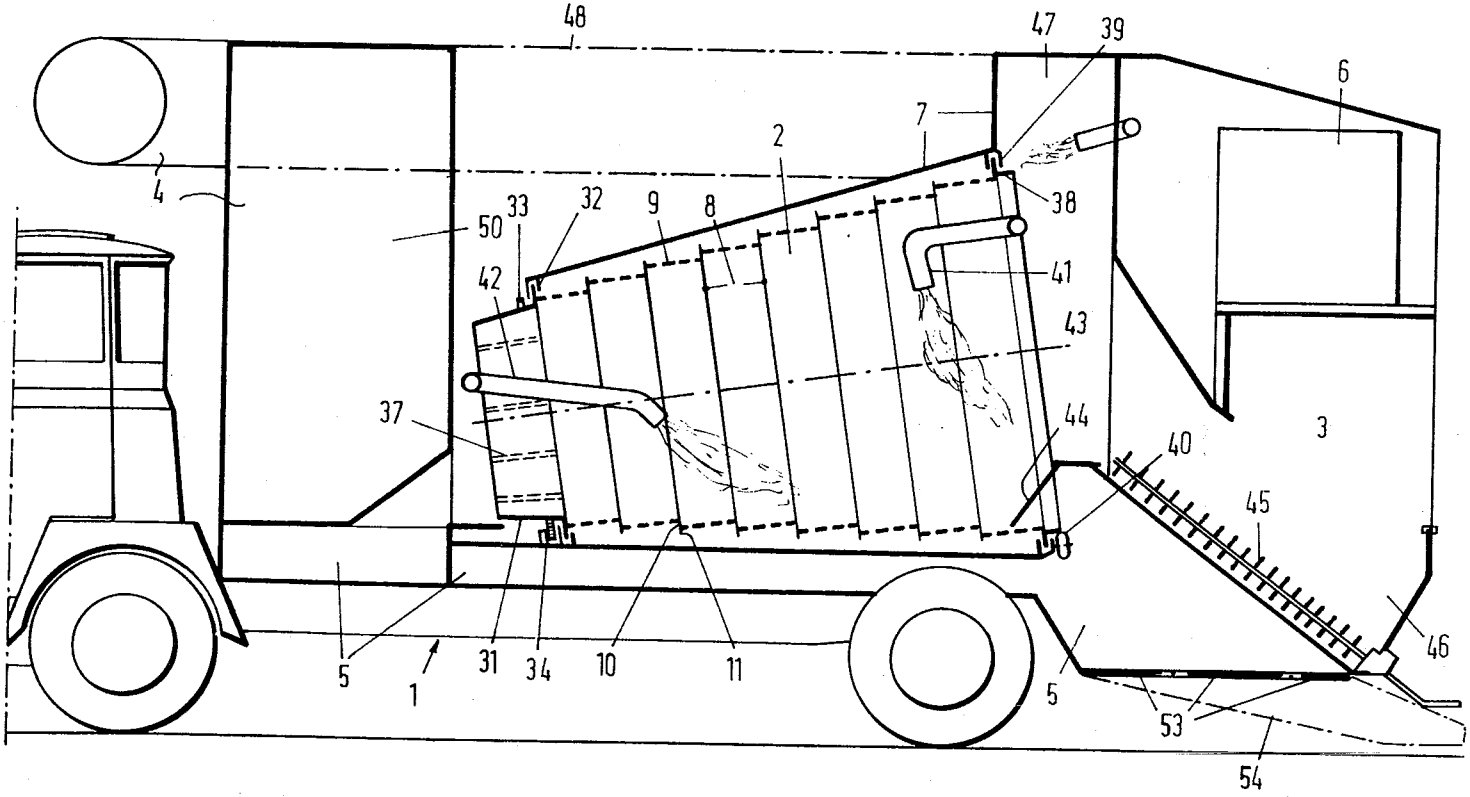
Figure 2:
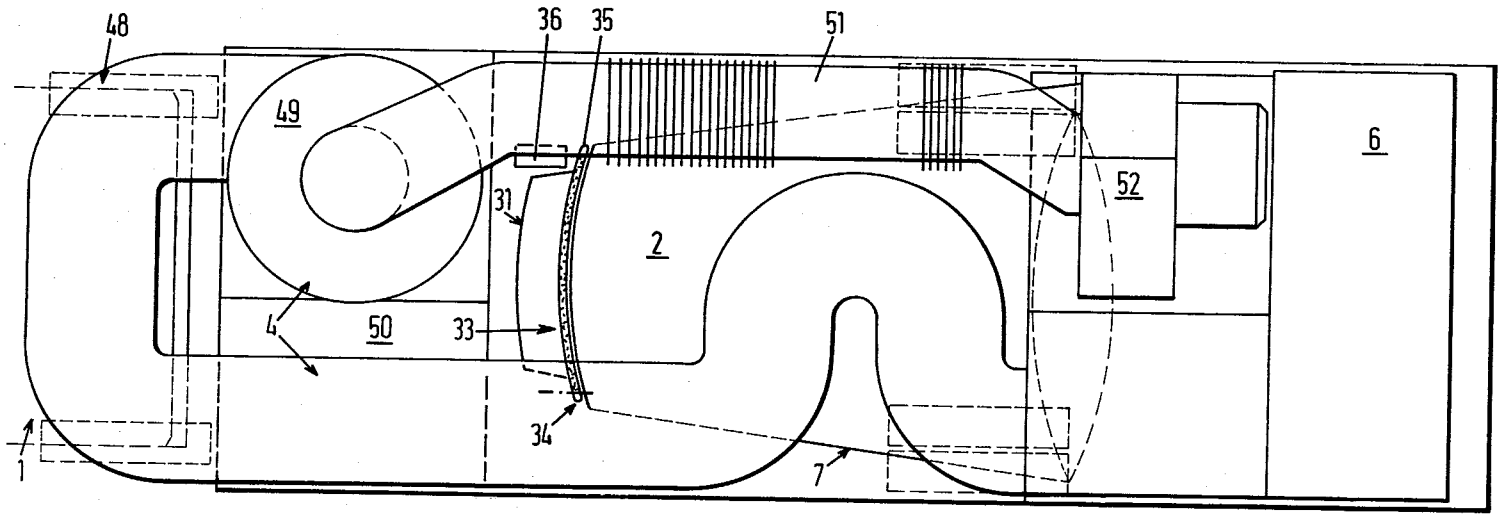
Figure 3:
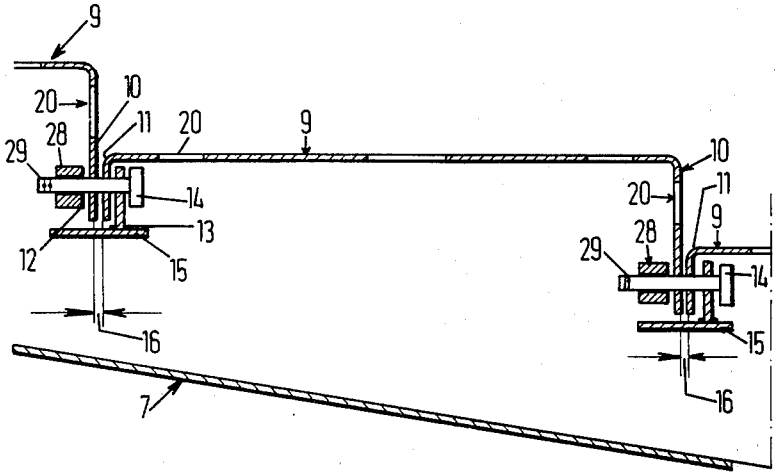
Figure 4:
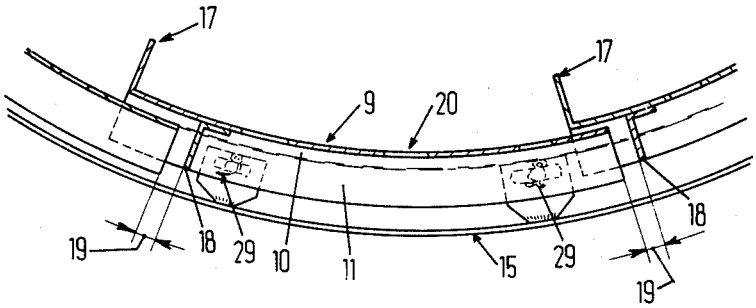
Figure 5:
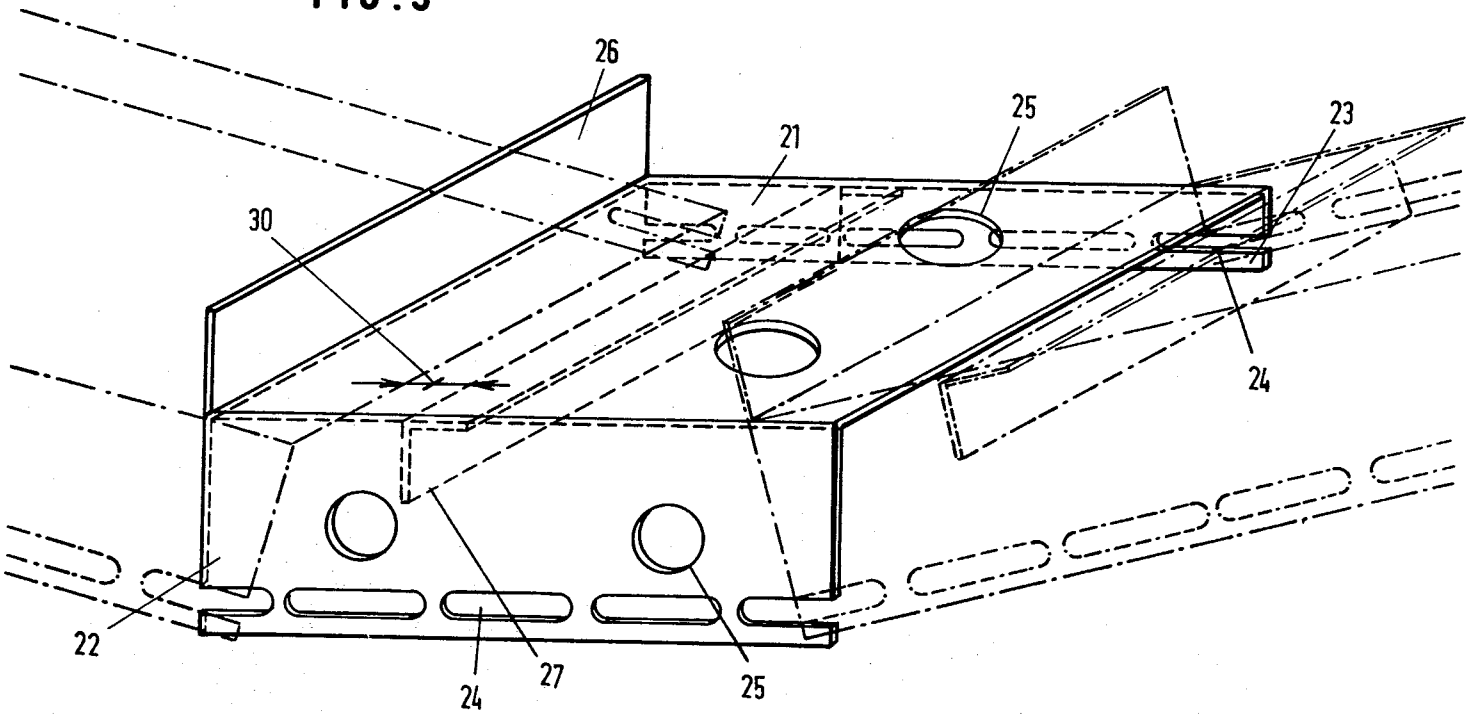

FIG. 1 is a longitudinal section of an incinerator unit according to the invention, FIG. 2 is a top view corresponding to the FIG. 1, FIG. 3 is a detail of the rotary grate in longitudinal section, FIG. 4 is a detail view of the rotary grate in transverse section, FIG. 5 is a perspective view illustrating a variant embodiment of the grate.

The described embodiment is the one wherein the incinerator unit is mounted on the chassis of a truck 1. It comprises an incinerator 2, a filling apparatus 3, a smoke purification system 4, an ash pit 5 and a power source 6.

The incinerator 2 is constituted by a stationary sheet steel casing 7 wherein rotates the rotary grate 8 which can have the form of a frustum of cone or of a frustum of pyramid without limitation of the number of faces. The revolution body formed by said grate is constituted by the assembly of sheet steel members forming a self-sustaining unit.

Said members 9 form a succession of crowns whose diameters diminish after the incinerator entrance towards the exit thereof. They are assembled one to the other by their radial faces 10 and 11, provided with holes 12 and 13 adapted to receive a pin 14 assembling the faces 10 and 11, and a junction plate 15 adapted to conceal the systematic clearance provided between said faces 10 and 11 in order to enable their free expansion in the longitudinal direction of the system. In radial sense the members are mounted in overlapping relationship, as shown in FIG. 4; one of their longitudinal edges 17 is raised towards the interior of the incinerator; its function is to entrain the refuse in rotation with the grate. A deflector 18, mounted on the external face of member 9, leaving a clearance 19 to allow free expansion of the said members in the transverse direction of the system, has the function to limit the passage of air blown through the rotary grate by the interstices of the overlapping members 9, because said air has to pass through the orifices 20 provided in the members 9, both on their longitudinal surfaces and on their radial faces, and properly distributed.

The air is blown between the grate 8 and the external casing 7 by a fan not shown and penetrates into the interior of said grate 8 by orifices 20.

According to a variant shown in FIG. 5, the members constituting the grate have the form of plates 21 identical for the entire grate, provided with flanges 22 and 23, with bores 24, orifices 25, a longitudinal flange 26 and a deflector 27, equivalent to radial faces 10 and 11, to bores 12 and 13, to orifices 20, to edges 17 and to deflectors 18 of the members 9. Like said members 9, members 21 are assembled by their radial faces 22 and 23 with the cover plates 15, by means of pins 14 provided with spacer sleeves 28 and split pins 29. The principle of free expansion in longitudinal direction is naturally preserved, as well as that of transversal expansion, providing a clearance 30 between the deflector 27 and the end of the adjacent member. The dimensions of said members are so chosen as to constitute a module, it being sufficient for the transition from a given ring to one whose diameter is slightly smaller, to remove one or a specific number of module elements.

In order to enable the assembly of said members on all diameters, the bores 24 are elongated and their dimensions are properly chosen relative to their center distances such that the passage of a pin 14 for all diameters of the rings is always ensured.

The grate 8 terminates at its exit end by a one-piece member, in the form of a conefrustum or pyramid frustum 31, to which the smallest of the rings 9 or 21 is connected. Said end member 31 carries a rotary joint 32 to ensure its tightness relative to the exterior casing 7 of the incinerator 2. It carries yet a ring gear 33, resting on the support pinions 34 and driving pinions 35 in rotation of the grate 8, the pinion 35 being mounted on the output shaft of a rotor reductor 36. Finally the end member 31 is provided with longitudinal ribs 37 to ensure the movement of the ashes in the incinerator.

At its entrance end the grate 8 is provided with a ring 38 carrying a rotary joint 39 to ensure its tightness with the exterior casing 7 of the incinerator 2. Said ring 38 runs on rollers 40 supporting the grate 8 in said end. Finally said ring 38 is assembled to the largest of the rings of members 9 or 21.

The members 9 or 21 are adapted to be mounted and replaced from the exterior of the system, enabling access to the grate 8 by means of movable panels of casing 7.

The refuse is burned on the grate by fuel burners 41, 42 disposed adjacent the entrance and the other adjacent the exit of the incinerator. The burners are fed by a reservoir and a pump (not shown), and are controlled by a known per se ignition and flame control equipment. A temperature regulation equipment known per se ensures an automatic operation; in case of insufficient temperature, oxygen injections or liquefied petroleum gas injections are made; in case of temperature excess, the fuel supply pressure is reduced.

The exterior casing 7 of the incinerator extends upstream of the entrance of the grate and contains in said place a pre-drying chamber 43, terminated by a charging spout 44. The back face of the chamber 43 adjoins the charging apparatus 3.

The charging apparatus 3 is of a know per se type and comprises a lifting member 45, also of a known per se type, having the function to transport refuse charged in the hopper 46 to the chamber 43. The lifting member can be advantageously associated with a crushing, tearing or compressing system, suitable for normalizing the dimension of the refuse.

The smoke purification system 4 comprises (following the movement of the smoke): the post-combustion zones, the dust removal apparatus, the smoke exhaust and evacuation fan transporting the air, then the mixture of air and impure gasses and afterwards the purified gasses across the entire unit starting at the end the entrance of the rotary grate through which the air is exhausted.

The smoke leaving the rotary grate 8 by its entrance end, passing in the upper part 47 of the casing 7, which forms the first post-combustion zone; this can be advantageously fitted with a fuel burner which is automatically put into operation when the temperature of the smoke is insufficient in said place. The other post-combustion zones 48 are formed by a succession of compartment for by a piping advantageously fitted with baffles. They extend to the dust removal apparatus which is located at the forward end of the unit behind the truck cabin.

The dust removal apparatus 49 is of a known per se type, as for example a centrifugal washer (shown) or a paddle washer. This washer is fed by a water reservoir 50 situated adjacent thereof behind the truck cabin through the intermediary of a pump. The purified smoke flue gasses leaving the apparatus 49 are exhausted by a pipe 51 provided with cooling ribs and connected to the section opening of the fan 52 which blows them to the atmosphere.

The ash pit 5 constitues the basis of the whole unit since it extends under the entire surface thereof, from the back face of the truck cabin to the back face of the charging apparatus 3. It is made of strong sheet steel strengthened by sections; it communicates by means of large gates with the water reservoir 50. Its lower faces are inclined from the front to the back to facilitate evacuation of ashes, which is effected under the influence of the presssure of the water reservoir 50. Ash distribution members such as endless screws or a scraper conveyors can be advantageously provided, and their putting into operation may be effected for instance by a differential gear driven by the shaft of the driving pinion of the rotary grate. The lower back end of the ash pit is closed by registers 53. A removable spout 54 may be disposed at this end for evacuating the ashes from underneath the truck.

The power source 6 may be a generating set mounted on the upper back part of the unit, above the filling apparatus 3.

Alternatively the incinerator unit according to the invention may be provided with a register which is automatically put into operation by a temperature control device, which register has the function to reduce the feed of the flue gas evacuation fan during the preheating period of the heating up.

The above description concerns the automobile version of the incinerator unit forming the object of the present invention, but it is also possible without leaving the scope of the invention to realize static units having all or part of the characteristics of the invention; said units might for instance not have a power source but be fitted with a known per se chimney and with dimensions in function of the administrative classification of the implantation. The automobile version has only been taken as an example because it contains all of the characteristics of the invention.

I claim:

1. A furnace for incinerating waste materials which comprises:

a stationary casing;

a frusto-conically shaped grate mounted for rotational movement within said casing; said grate formed by a plurality of cylindrically-shaped, juxtaposed rings, said rings having radially and outwardly extending face members including orifice means for joining adjacent face members for expansion by pins, each ring member being formed of a plurality of overlapping subsections; and means for rotating said grate.

2. The furnace according to claim 1 characterized in that there are provided rotating joints at each end of the grate so as to ensure its tightness with respect to the stationary casing.

3. The furnace according to claim 1 characterized in that oxygen and liquefied petroleum gas injections can be automatically effected by means of a known per se temperature control system in case of insufficient temperature to add their effect to that of the main fuel burners; the pressure thereof can be decreased by the same regulator device in case of excess of temperature.

4. The furnace as defined in claim 1 including a cylindrically-shaped member mounted to said grate proximate to junctures of radially-extending face members.

5. The furnace as defined in claim 1 wherein said subsections are of like sizes.

6. An incinerator unit including the furnace as defined in claim 1 and additionally comprising an external casing which envelopes said stationary casing, said external casing provided with a predrying chamber means disposed upstream of the entrance to said furnace for predrying said waste materials to be treated with hot flue gases withdrawn from said furnace.

7. The incinerator unit as defined in claim 6 and additionally comprising post combustion zone means for receiving said hot flue gas, said zone means including burner means for maintaining operational temperatures therein.

8. The incinerator unit as defined in claim 6 and additionally comprising an ash pit means disposed between said furnace and said external casing to receive hot ashes, one end of said ash pit being disposed beneath a water reservoir to permit selective discharge of water from said reservoir into said pit to extinguish said ashes and to transport said ashes to a discharge zone of said incinerator unit.

9. The incinerator unit as defined in claim 8 wherein said incinerator includes a flue gas purification system including a flue gas fan means for discharging flue gas from said incinerator.

10. The incinerator unit as defined in claim 9 wherein a register is provided in said flue gas purification system to permit recycle of flue gas during start-up.

* * * * *